US007503741B2

(12) United States Patent
Gillest

(10) Patent No.: US 7,503,741 B2
(45) Date of Patent: Mar. 17, 2009

(54) FORMATION OF A CURL IN A UNITARY CLOSABLE CONTAINER

(75) Inventor: Kevin Gillest, Arvada, CO (US)

(73) Assignee: Omnitech International, Inc., Denver, CO (US)

( * ) Notice: Subject to any disclaimer, the term of this patent is extended or adjusted under 35 U.S.C. 154(b) by 0 days.

(21) Appl. No.: 12/098,879

(22) Filed: Apr. 7, 2008

(65) Prior Publication Data

US 2008/0253862 A1 Oct. 16, 2008

Related U.S. Application Data

(63) Continuation-in-part of application No. 12/015,480, filed on Jan. 16, 2008.

(60) Provisional application No. 60/880,682, filed on Jan. 16, 2007.

(51) Int. Cl.
*B21D 51/28* (2006.01)
*B21D 22/18* (2006.01)

(52) U.S. Cl. ..... 413/1; 413/73; 72/124; 72/126; 72/370.04; 72/379.4; 72/715

(58) Field of Classification Search ..... 413/1, 413/2, 4, 6, 31, 36, 37, 55, 71, 72, 73; 29/512; 72/120, 121, 124, 126, 370.04, 379.4, 703, 72/715

See application file for complete search history.

(56) References Cited

U.S. PATENT DOCUMENTS 3,995,572 A 12/1976 Saunders
5,121,621 A * 6/1992 Ihly ..... 72/126
5,293,765 A 3/1994 Nussbaum
5,557,963 A 9/1996 Pogacnik
5,572,893 A 11/1996 Goda
5,704,240 A 1/1998 Jordan
5,718,352 A 2/1998 Diekhoff et al.
5,755,354 A 5/1998 Lang
5,778,723 A 7/1998 Diekhoff
5,853,275 A * 12/1998 Lentz et al. ..... 413/73
5,947,309 A 9/1999 Anderson
6,010,026 A 1/2000 Diekhoff et al.
6,010,028 A 1/2000 Jordan et al.
D442,865 S 5/2001 Lang
6,543,636 B1 4/2003 Flecheux et al.
6,779,677 B2 8/2004 Chupak (Continued)

FOREIGN PATENT DOCUMENTS

GB 827115 3/1960

(Continued)

*Primary Examiner*—Jimmy T Nguyen
(74) *Attorney, Agent, or Firm*—William W. Cochran; Cochran Freund & Young LLC

(57) ABSTRACT

Disclosed is a device and method for forming a curl in a closable container. A process of forming a pre-curl is used, which is followed by a second separate step of forming the completed curl. The two-step process provides for higher tolerances with respect to the shape of the curl that allows the curl to be used as a sealing surface for a recloseable metal bottle. A three-step process provides for even greater tolerances and reduces longitudinal forces by completing the curl using lateral forces. Also, a die curler is disclosed that has an eccentric motion that forms a curl in a single progressive curling process.

6 Claims, 13 Drawing Sheets

U.S. PATENT DOCUMENTS

| | | | | |
|---|---|---|---|---|
| 6,857,304 | B2 | 2/2005 | Enoki | |
| 6,959,830 | B1 | 11/2005 | Kanou et al. | |
| 2004/0256346 | A1 | 12/2004 | Becker et al. | |
| 2007/0044530 | A1* | 3/2007 | Grogan | 72/126 |
| 2007/0249424 | A1 | 10/2007 | Marshall et al. | |

FOREIGN PATENT DOCUMENTS

| | | |
|---|---|---|
| WO | WO2007123716 | 11/2007 |

* cited by examiner

FORMATION OF A CURL IN A UNITARY CLOSABLE CONTAINER

CROSS REFERENCE TO RELATED APPLICATION

This application is a continuation-in-part application of U.S. application Ser. No. 12/015,480, entitled "FORMATION OF A CURL IN A UNITARY CLOSABLE CONTAINER," filed Jan. 16, 2008, which application is based upon and claims the benefit of U.S. provisional application Ser. No. 60/880,682, entitled "FORMATION OF A CURL IN A UNITARY METAL BOTTLE," filed Jan. 16, 2007, the entire disclosures of which are herein specifically incorporated by reference for all that they disclose and teach.

BACKGROUND OF THE INVENTION

Forming operations of metal cans have been used for many years. Necking operations are known to harden the metal material, especially when multiple necking operations are used to decrease the diameter of the opening in the can. Recently, similar processes have been used to form metal bottles and other closable containers. Unique problems are encountered in the formation of metal bottles because of the large number of necking procedures that are required to create the smaller opening of a metal bottle.

SUMMARY OF THE INVENTION

The present invention may therefore comprise a process of forming a curl at the end of a neck of a metal container comprising: providing a symmetrical curl die having a centerline and an opening in said curl die that is off-center from said centerline; placing a spindle through said opening in said curl die so that said curl die is eccentrically mounted on said spindle; rotatably mounting a pilot on said spindle in alignment with said centerline so that said pilot rotates concentrically around said spindle; rotating said spindle so that said curl die rotates eccentrically around said centerline; placing said neck of said container over said pilot so that said neck of said container is aligned with said centerline; progressively engaging said neck of said container with said curl die as said curl die rotates eccentrically around said spindle to progressively form said curl in said neck.

The present invention may further comprise a device for forming a curl at the end of a neck of a metal container comprising: a pilot that is inserted in an opening of said neck of said metal container that holds said metal container in a substantially stationary position; a spindle that is concentrically rotatably attached to said pilot so that said spindle rotates concentrically with respect to said container; a curl die that is eccentrically mounted to said spindle that progressively engages said neck as said curl die is rotated by said spindle.

DETAILED DESCRIPTION

Figure 1:
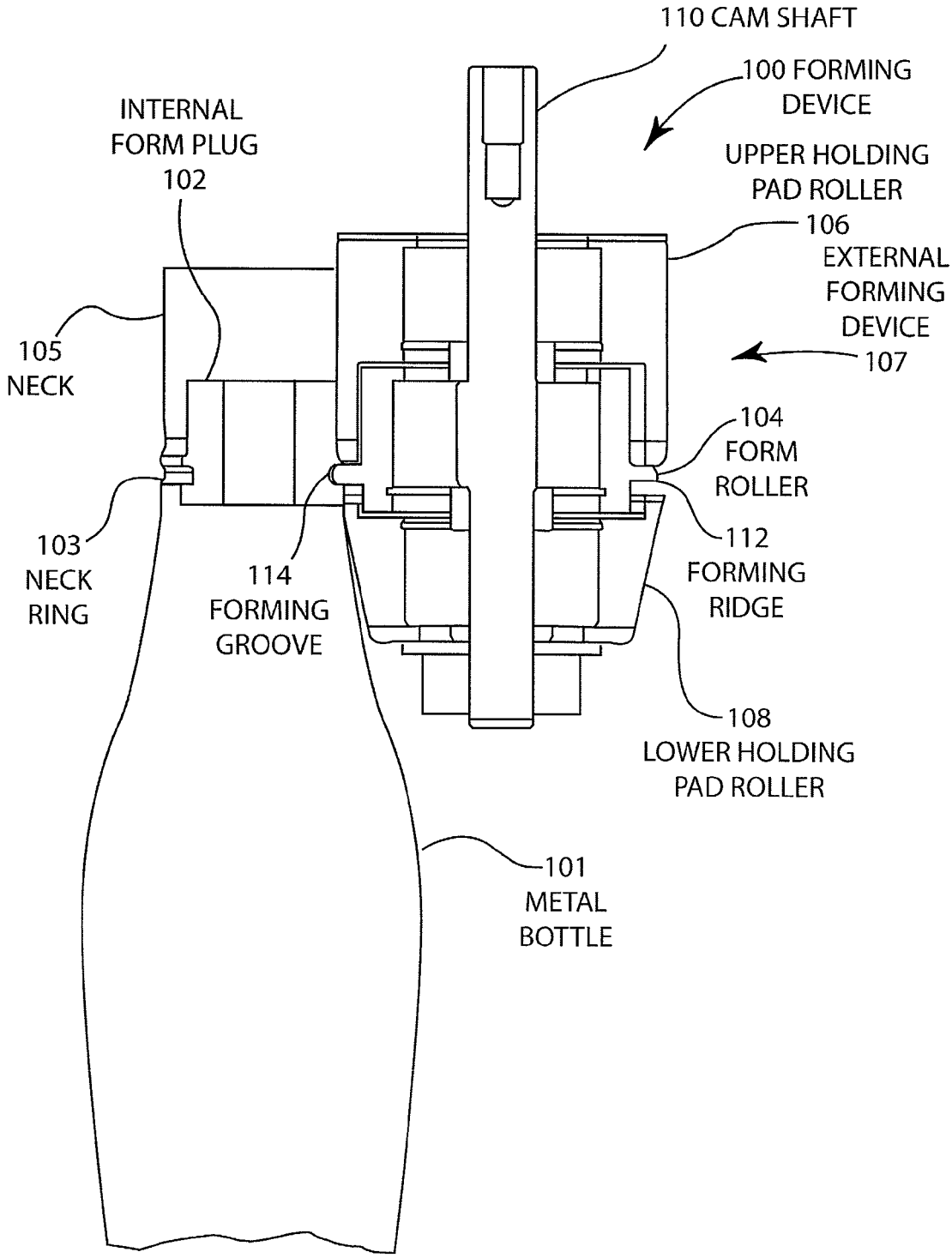
FIG. 1 illustrates the process of forming a neck ring.

FIG. 1 illustrates a forming device 100 for forming a neck ring 103 in a metal bottle 101. Although FIG. 1, as well as other figures, disclose a metal bottle, the processes for forming a curl that are disclosed herein, can be used on various types of closable containers, including threaded containers that have threaded caps, containers that are closable with a crown, containers that have lugs that are closable with a cap, etc. As shown in FIG. 1, the neck ring 103 comprises the first ring when moving vertically upward along the surface of the bottle to the neck and provides structure and stability for the neck 105 of the metal bottle 101. An internal form plug 102 is used in conjunction with the external forming device 107 to form the neck ring 103.

In operation, the metal bottle 101 is loaded into a station (not shown) that has a rotating base plate (not shown) but known to those skilled in the art. The internal form plug 102 is then inserted in the opening at the top of the bottle 101. The internal form plug 102 is moved vertically to the proper height inside neck 105. The internal form plug 102 is then moved horizontally towards the external forming device 107 until the internal form plug 102 contacts the inside of the neck 105 of the metal bottle 101. The external forming device 107 is moved horizontally towards the bottle neck and internal form plug 102 until the upper holding pad roller 106 and the lower holding pad roller 108 are in contact with the side of the metal bottle 101.

To form the neck ring 103 as shown in FIG. 1, a form roller 104, that is part of the external forming device 107, has a forming ridge 112 that mates with a forming groove 114 in the internal form plug 102. Cam shaft 110 then rotates so that the eccentric form roller 104 causes the forming ridge 112 to push inwardly into the forming groove 114 on the internal form plug 102 to form the neck ring on the neck 105 of the metal bottle 101 as metal bottle 101 rotates in the station. After the neck ring 103 is formed in neck 105 of metal bottle 101, the external forming device 107 is moved horizontally away from the bottle. Internal form plug 102 is also moved horizontally away from the side of the neck 105 and pulled upwardly from the opening in the metal bottle 101. The formation of the neck ring is then complete.

Figure 2:
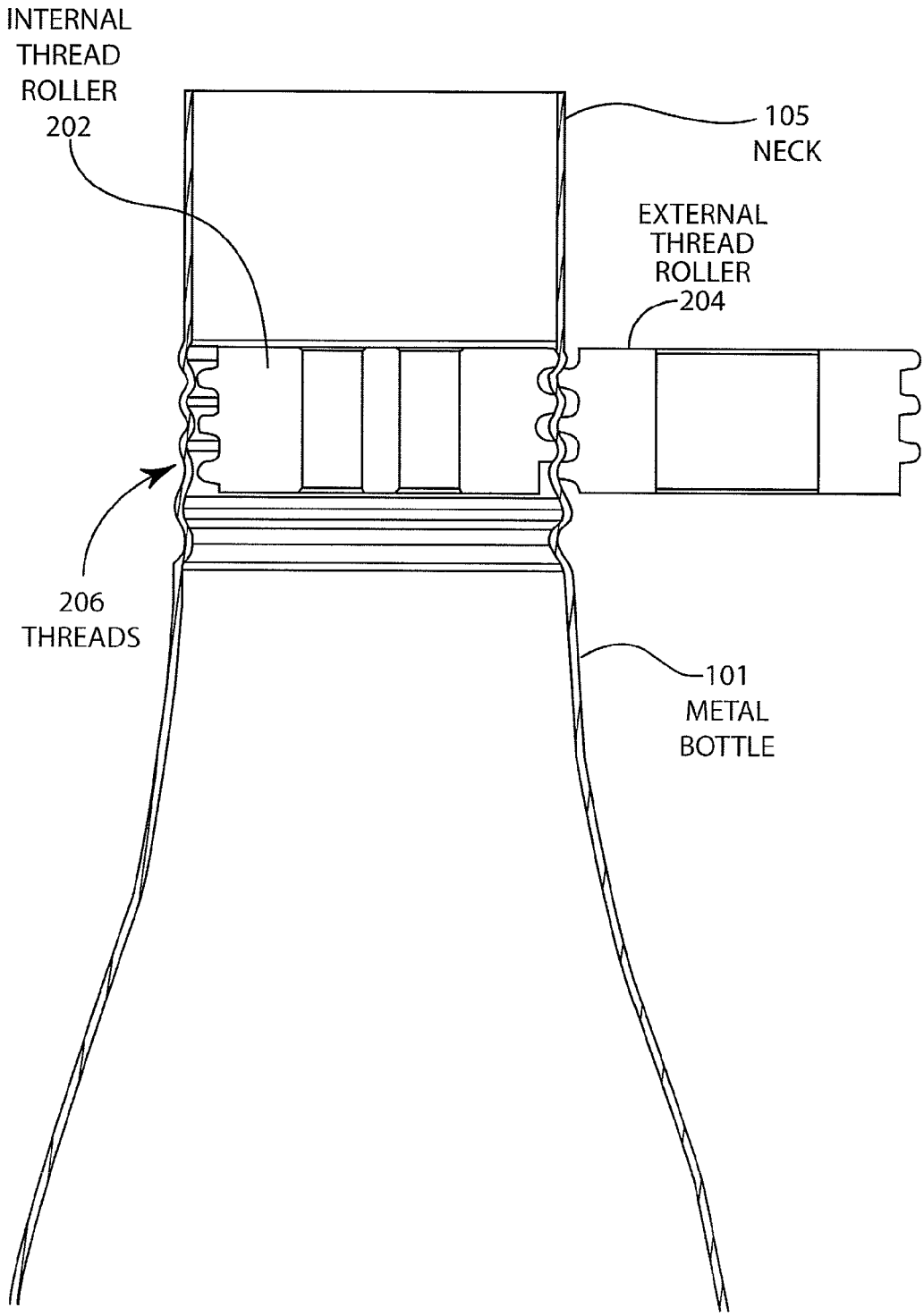
FIG. 2 illustrates the process of forming threads.

FIG. 2 illustrates the process performing threads in the neck 105 of the metal bottle 101. The metal bottle 101 is loaded into a station (not shown) having a rotating base for forming the threads in the neck 105 of the metal bottle 101. An internal thread roller 202 is then inserted in the opening of the neck 105 and moved to the proper height for formation of the threads 206. The internal thread roller 202 then moves horizontally until it touches the inside surface of the neck 105. An external thread roller 204 moves horizontally towards the bottle until it contacts the neck 105 of the metal bottle 101. The external thread roller 204 then slowly moves towards the internal thread roller 202 as the metal bottle 101 is rotated and the external thread roller 204 is rotated so that the threads 206 are formed in the neck 105 of the metal bottle 101 when the ridges of the external thread roller 204 engage the grooves in the internal thread roller 202. The external thread roller 204 is then moved horizontally away from the bottle, and the internal thread roller 202 is moved away from the internal surface of the neck 105 and removed from the metal bottle 101.

Figure 3:
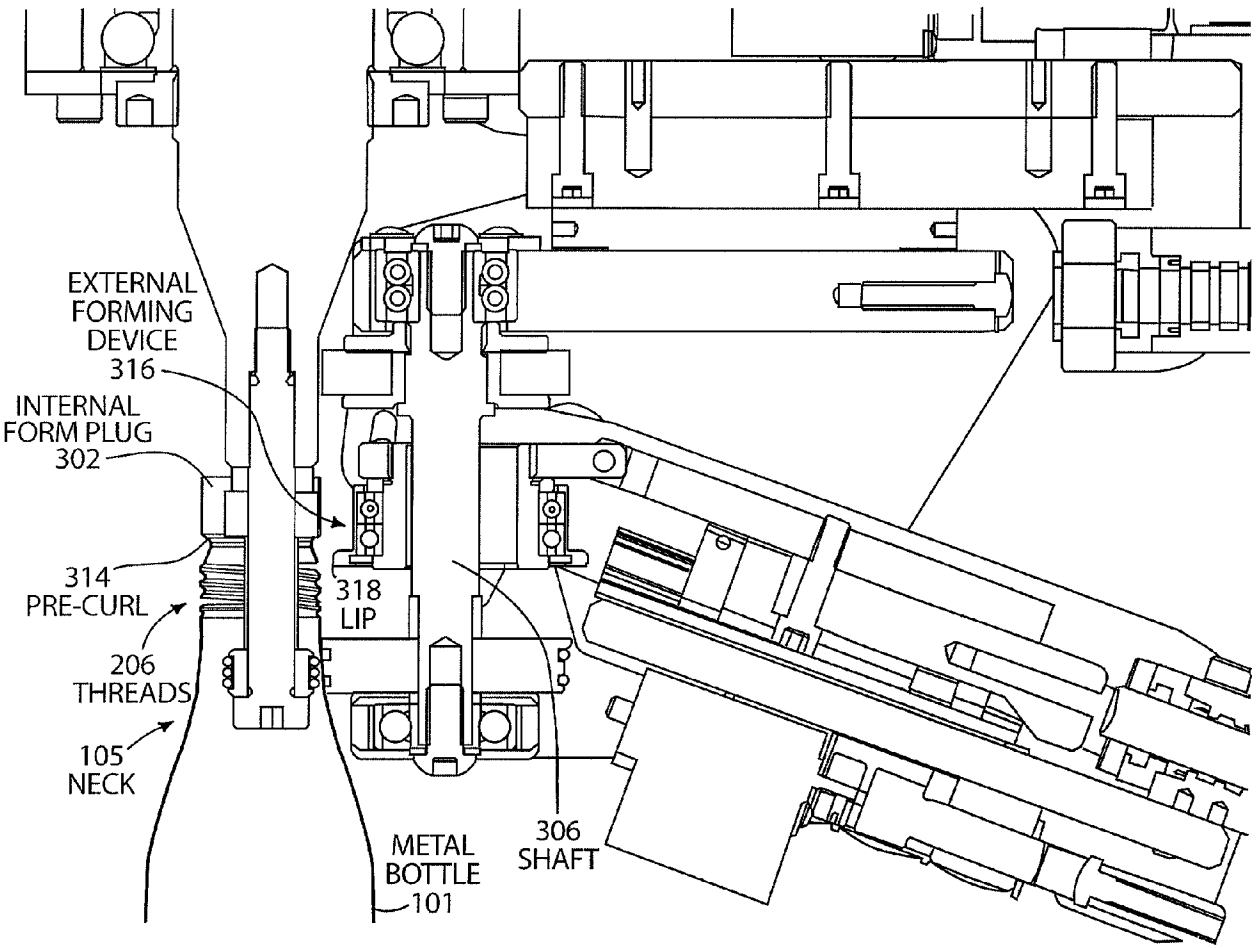
FIG. 3 illustrates the process of forming a pre-curl.

FIG. 3 illustrates the process for forming a pre-curl 314 in the neck 105 of the metal bottle 101. The metal bottle 101 is first moved into a station (not shown) for forming the pre-curl that includes a rotating base (not shown). An internal form plug 302 is inserted into the opening in the neck 105 of the metal bottle 101 and moved to the proper height for forming the pre-curl. The internal form plug 302 is then moved horizontally to the right until it contacts the inside of the neck 105. An external forming device 316 is then used in conjunction with the internal form plug 302 to form the pre-curl 314. The external forming device 316 includes a shaft 306. The external form roller 304 is moved inwardly towards the bottle neck and upwardly to a position above the threads 206 until the form roller 304 contacts the side of the metal bottle. Shaft 306 then rotates to rotate the metal bottle 101 which allows the lip 318 of the form roller 304 to engage the neck 105 of the metal bottle 101 in the groove of the internal form plug 302 to form roll and create the pre-curl 314.

The pre-curl 314 is a partially formed curl that extends outwardly in nearly a horizontal direction away from the neck 105 of the metal bottle 101. The formation of the pre-curl 314 allows the metal in the neck 105 to be formed in a partially curled configuration that has less spring back than if a complete curl was formed in one single operation. If a full curl were to be formed in one operation, the formation of the full curl would have to be overdone or over-curled to ensure that the curl was properly formed as a result of spring back. The tolerances of the top surface of a curl that is fully formed in a single operation may be less than desirable as a result of the curl being over-formed or over-curled and then sprung back to a proper position. By forming a pre-curl, there is clearly less spring back that occurs in both the initial pre-curl and final curl process, as disclosed with respect to FIG. 5. The two-step process of forming a pre-curl and then forming a final curl therefore provides for a greater design capability and produces close tolerances as to the shape and flatness of the curl. Of course, the two-step process also allows the second step to modify or correct imperfections in the first step, which further provides for closer tolerances in the final curl.

Other ways of forming the pre-curl may include multiple necking operations. For example, six to eight necking operations may be required to form the pre-curl. However, such processes are expensive and require many steps. In addition, such processes include a substantial amount of work hardening of the metal. In that regard, the roll forming process, illustrated in FIG. 3, is a single step process that is simpler, less expensive and works the metal in the neck 105 to a much lesser extent than multiple necking operations. In addition, the one-step process of roll forming the pre-curl 314 eliminates numerous trimming stages that may be required when multiple necking operations are performed.

Figure 4:
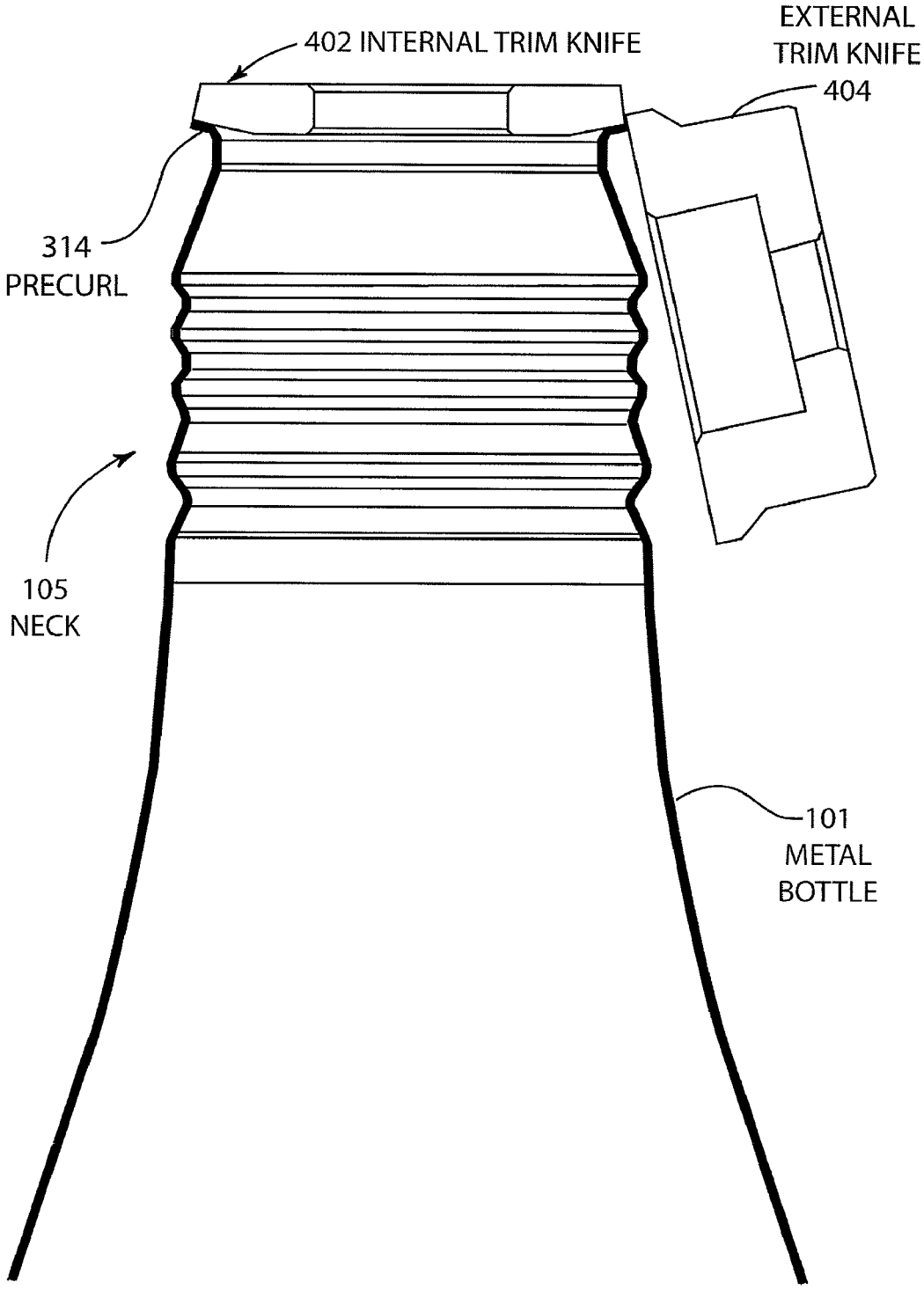
FIG. 4 illustrates the process of trimming the pre-curl scrap ring.

The process of forming a pre-curl in the neck as shown in FIG. 3 also allows the upper portion of the neck 105 to be cut away from the pre-curl in a single step, as illustrated with respect to the description of FIG. 4. This allows the upper portion of the neck 105 to be used, if desired, in the manner disclosed in U.S. patent application Ser. No. 11/468,911, filed Aug. 31, 2006, by Christopher J. Olson, entitled Recloseable Metal Bottle, which is specifically incorporated herein by reference for all that it discloses and teaches. U.S. patent application Ser. No. 60/823,122, filed Aug. 22, 2006, by Christopher J. Olson, entitled Metal Bottle Seal, is also specifically incorporated herein by reference for all that is discloses and teaches. Further, the formation of the pre-curl 314 in a continuous neck 105, as opposed to a pre-cut piece, also helps in stabilizing the formation of the pre-curl which further aids in obtaining the closer tolerances in the final curl.

FIG. 4 schematically illustrates the process of trimming the pre-curl scrap ring. Metal bottle 101 is initially loaded into a station having a rotating base. An internal trim knife 402 is then placed in the opening in the neck 105 of the bottle. The internal trim knife 402 is then moved vertically to the proper position at which a cut is to be made. The internal trim knife 402 is then moved horizontally until it contacts the interior surface of the pre-curl 314. An external trim knife 404 is then moved in a slight upward angle to pierce through the edge of the pre-curl adjacent to the internal trim knife 402. The bottle is then rotated in the neck 105 adjacent to the pre-curl 314 and is cut to produce a scrap ring that is removed from the station.

Figure 5:
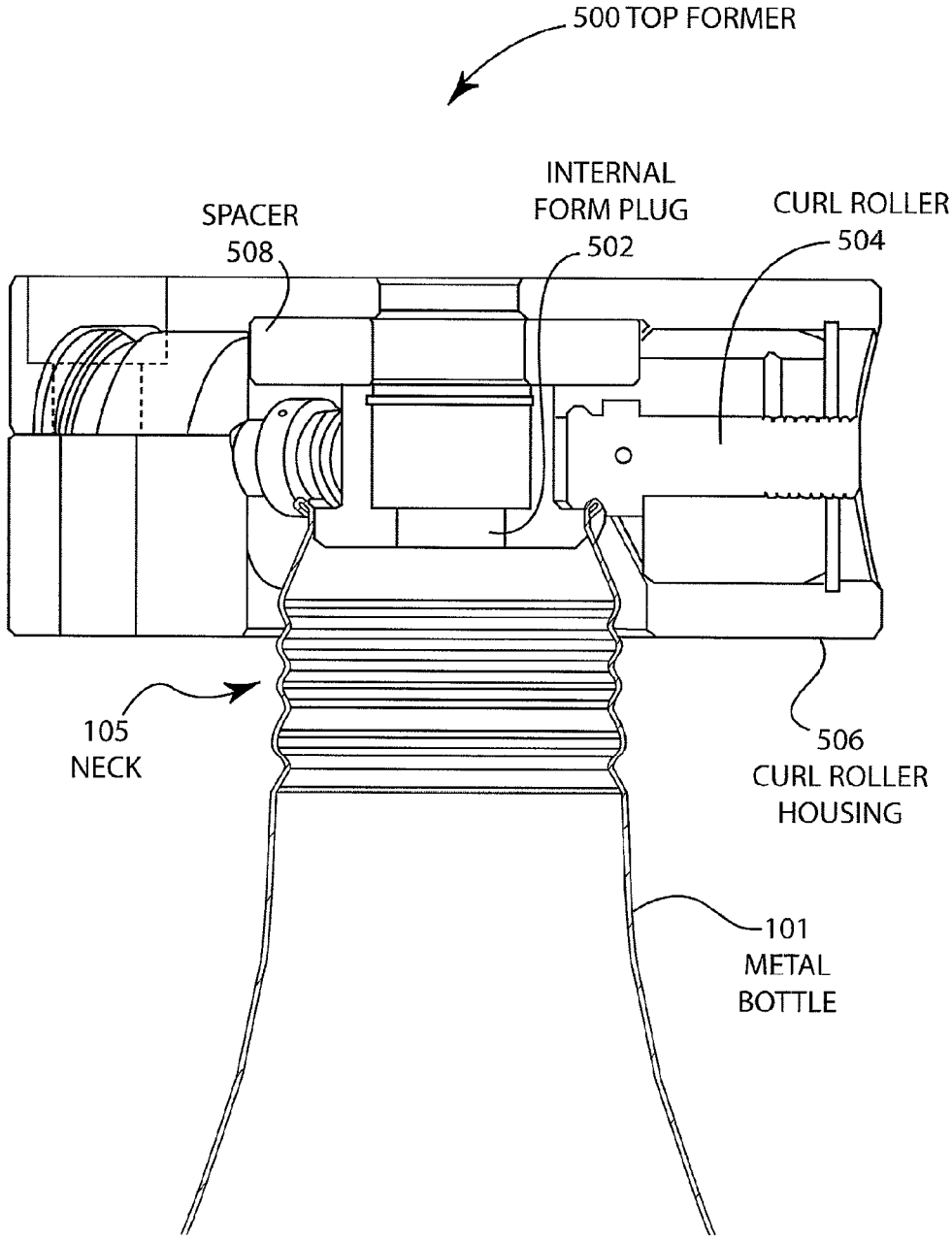
FIG. 5 illustrates the process of completing the curl on the top of the metal bottle.

FIG. 5 is a schematic illustration of a top former 500 for completing the curl at the top of the metal bottle 101. Again, the bottle is loaded into a station having a rotating base, and an internal form plug 502 is inserted into the opening in the neck of the metal bottle 101. The internal form plug 502 is then moved vertically to the proper height for forming the completed curl on the top of the neck 105 of the metal bottle 101. External curl rollers, such as external curl roller 504, is then positioned over the pre-curl 314, as illustrated in FIG. 4. The curl roller 504 is disposed within a curl roller housing 506 which is moved vertically with respect to the internal form plug 502 as the final curl is formed at the end of the neck 105 of the metal bottle 101. The curl roller 504, as well as the other curl rollers, has a groove that is positioned directly over the pre-curl. The curl roller 504 is then moved in a downward direction as the bottle is rotated so that the groove in the curl roller 504 engages the pre-curl 314 and folds the pre-curl in a downward direction to complete the final curl at the top edge of the neck 105 of the metal bottle 101. Spacer 508 locates the curl roller housing 506 with respect to the internal form plug 502. The curl roller housing 506 can then be moved in an upward direction, as well as the internal form plug 502, to complete the process. This embodiment provides a two-step process for forming a curl in the neck of a metal bottle that provides a high degree of tolerance on the flat surface of the curl so that a reliable sealing edge is created.

Figure 6:
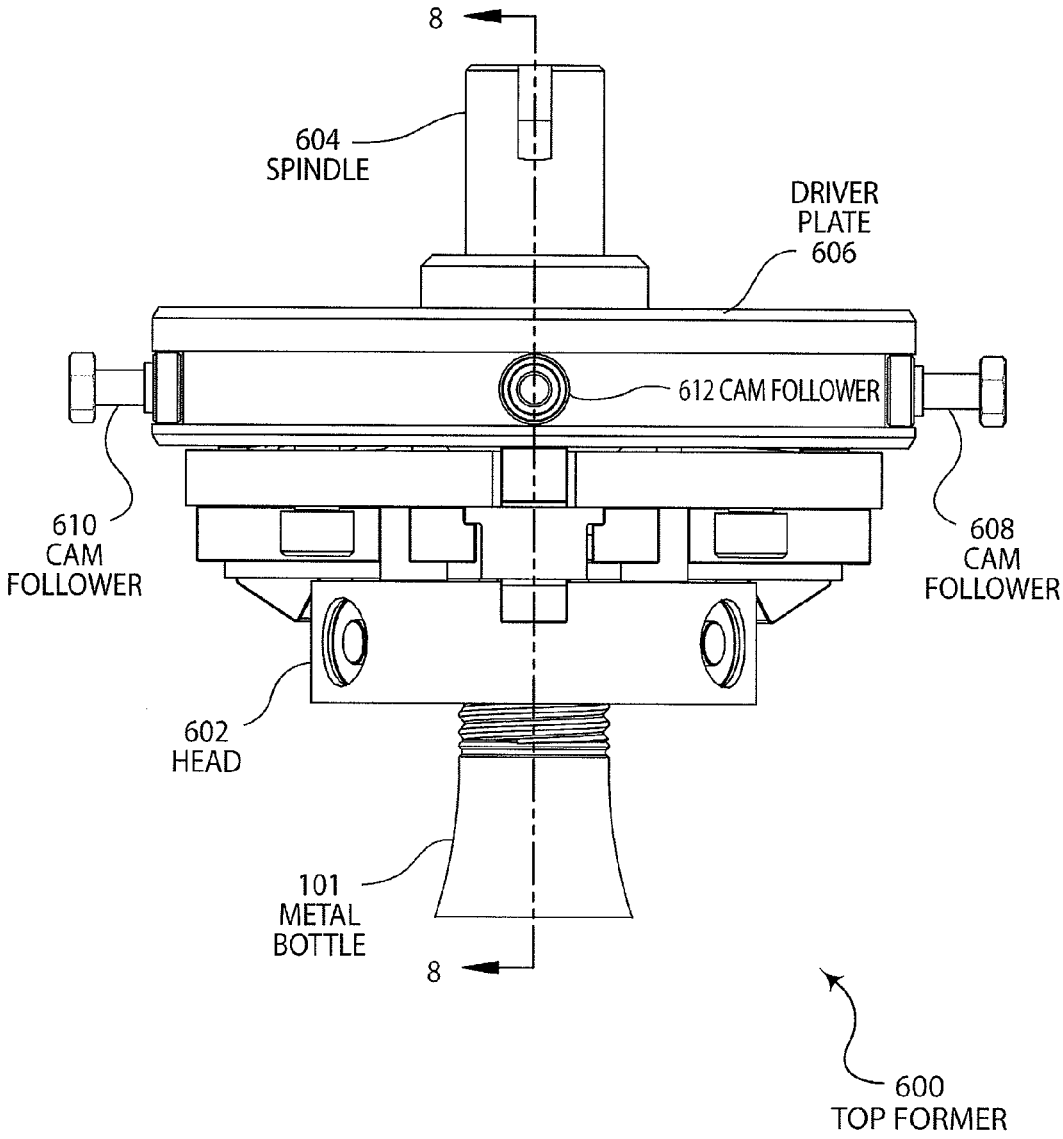
FIG. 6 is a side view of another embodiment of a top former.

FIG. 6 is a side view of another embodiment of a top former 600. Top former 600 is used to complete the curl in the neck of the bottle from the pre-curl curvature to the completed curl curvature at the top of the neck of the metal bottle 101. Top former 600 has a head 602 in which the top of the neck of the metal bottle 101 is placed. Spindle 604 is used to position the top former 600 over the bottle and apply an initial downward pressure on the neck of the metal bottle 101, as well as rotate to form the intermediate curl, using an intermediate curl roller 816 (FIG. 8). Top former 600 also includes a driver plate 606 that is driven in a vertically downward direction by cam followers 608, 610, 612, 702 (FIG. 7) to finish the curl, using a finish curl roller 814 (FIG. 8), as disclosed in more detail below.

Figure 7:
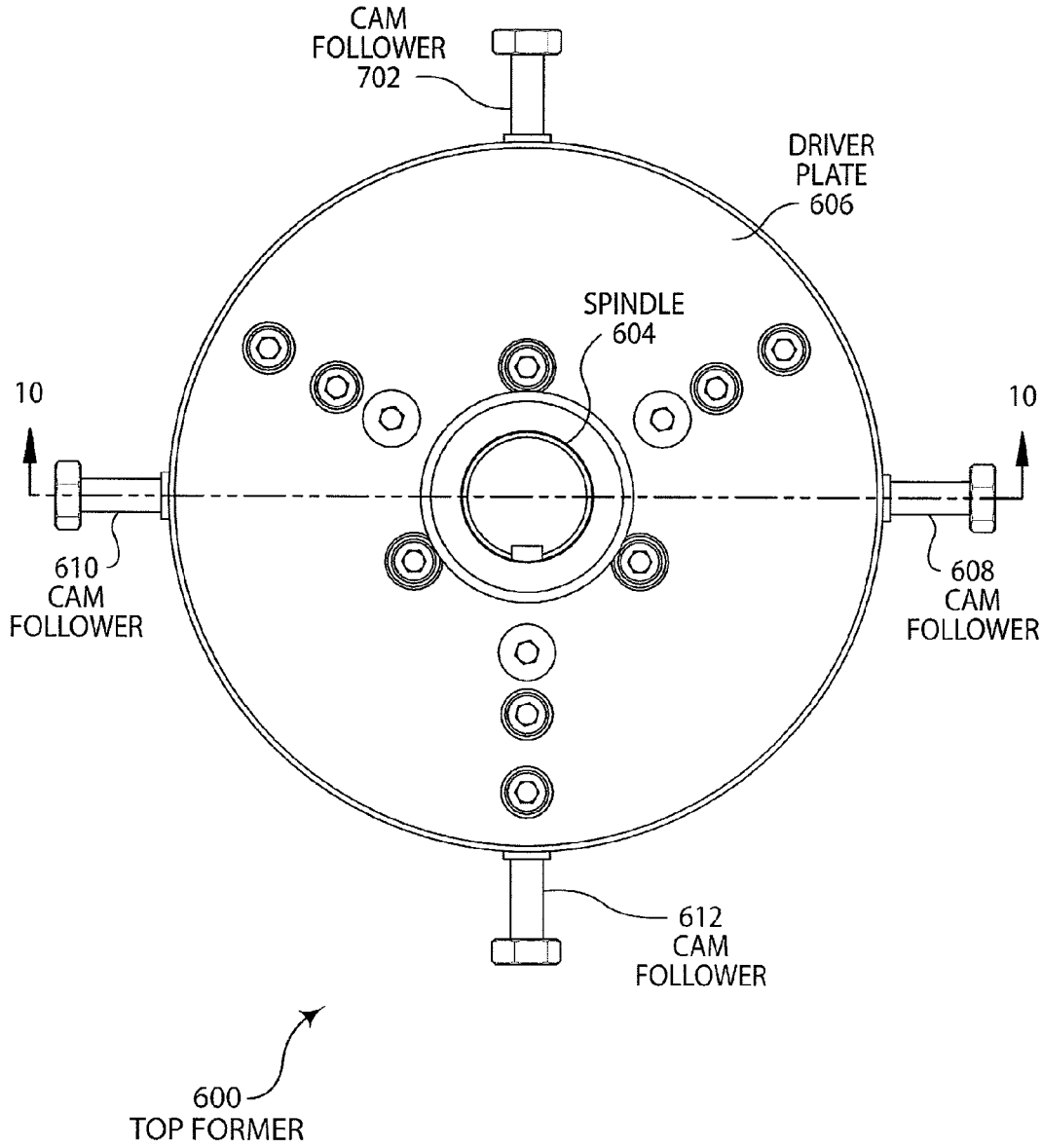
FIG. 7 is a top view of the top former of FIG. 6.
Figure 8:
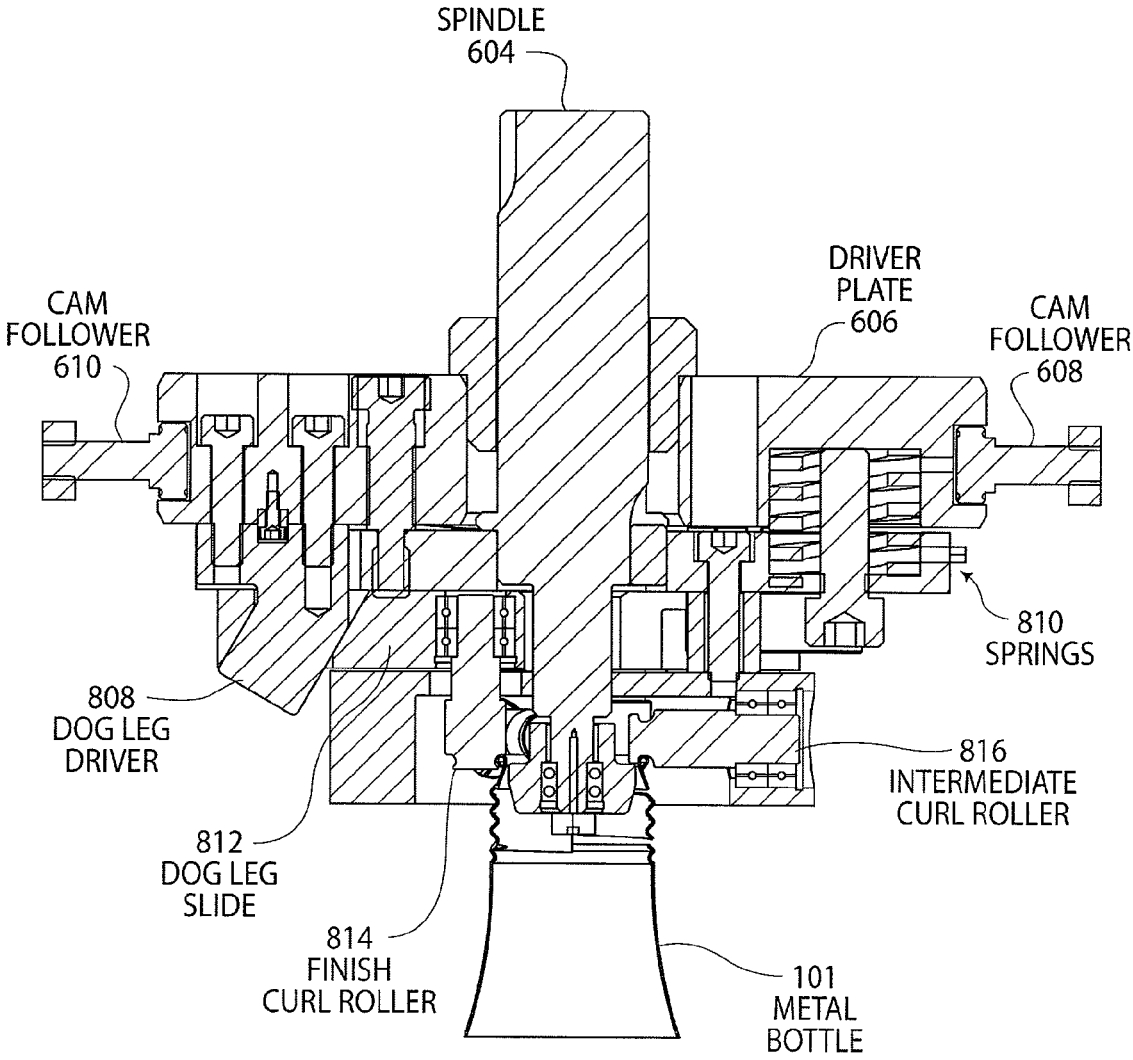
FIG. 8 is a cross-sectional view of the top former of FIG. 6.

FIG. 7 is a top view of the top former 600. As shown in FIG. 7, the cam followers 608, 610, 612 and 702 are placed evenly around the driver plate 606. FIG. 7 also illustrates the spindle 604.

Figure 9:
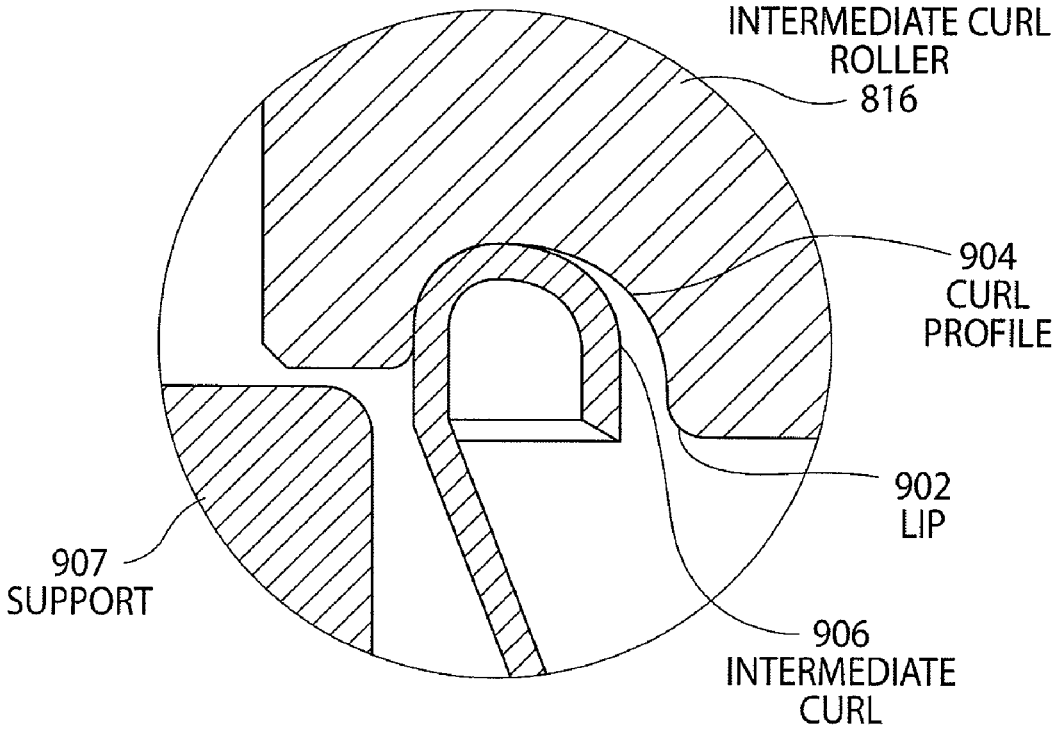
FIG. 9 is an exploded view of a portion of the drawing of FIG. 8.

FIG. 8 is a cross-sectional view of FIG. 6. FIG. 8 illustrates the spindle 604, the driver plate 606, the cam followers 608, 610 and the metal bottle 101. As also illustrated in FIG. 8, an intermediate curl roller 816 is used to create an intermediate curl in the pre-curl 314, that is illustrated in FIG. 4. The process of creating an intermediate curl is illustrated and described in more detail with respect to FIG. 9. The final curl is completed in finish curl roller 814, that is illustrated in more detail in FIG. 11. The intermediate curl roller operates by engaging the pre-curl 314 (FIG. 3) with a curl profile 904 in the intermediate curl roller 816, as illustrated in FIG. 9. The engagement of the pre-curl is accomplished by moving the spindle 904 in a downward direction, so that the curl profile 904 of the intermediate curl roller 906 causes the pre-curl to curl farther, in accordance with curl profile 904. Lip 902 guides the end of the curl 906, as illustrated in FIG. 9. A minimal amount of force is applied in a longitudinal downward direction by the spindle 904 to cause the curl 906 to conform to the curl profile 904 of the intermediate curl roller 816, so as to prevent crushing of the neck of the metal bottle.

Figure 11:
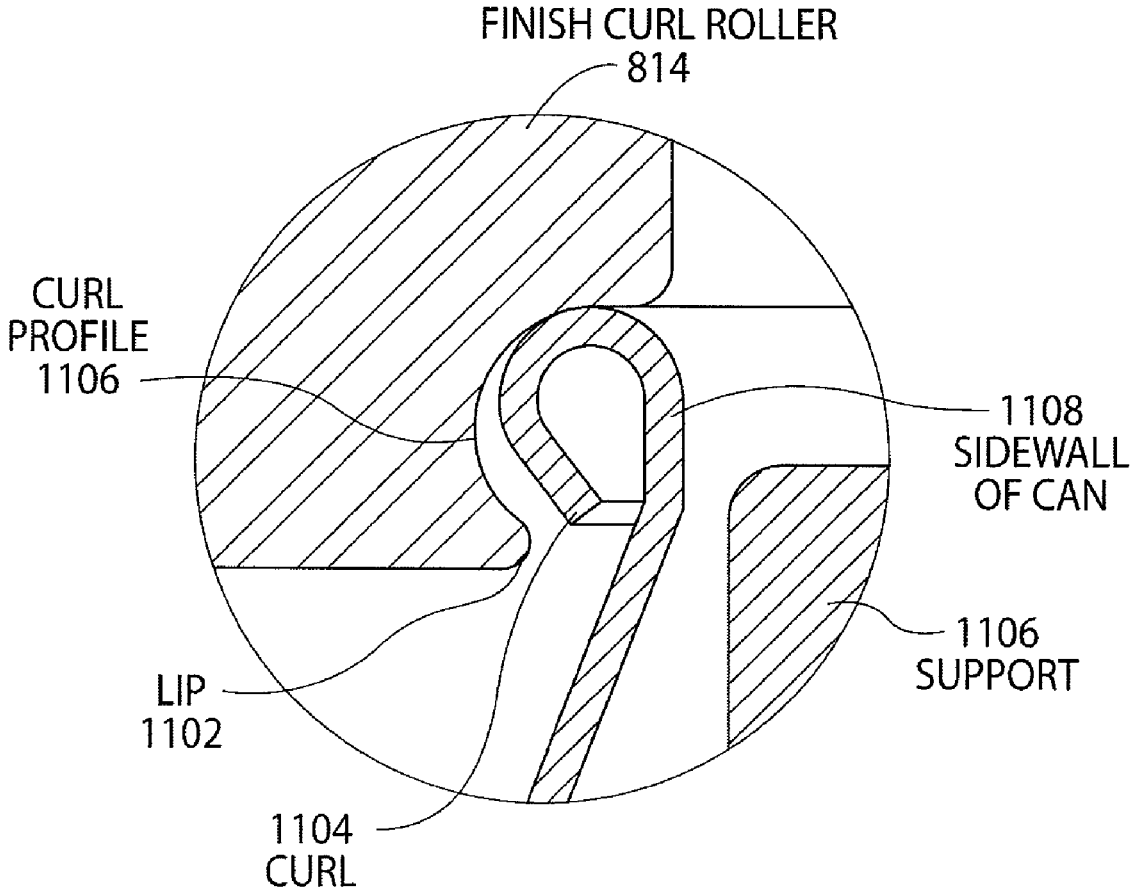
FIG. 11 is an exploded view of a portion of FIG. 8.

FIG. 8 also illustrates the finish curl roller 814. Finish curl roller 814 operates by applying pressure to curl 906 (FIG. 9) in a lateral or a horizontal direction, as shown in FIGS. 8 and 11, using the finish curl roller 814 that has a curl profile 1106. Lip 1102 (FIG. 11) engages the curl 1104 (FIG. 11) to force the end of the curl into the sidewall of the metal bottle 1108 (FIG. 11) to complete the curl. The finish curl roller 814, as disclosed in FIG. 8, is moved in a lateral or a horizontal direction in the following manner. A downward (longitudinal) force is applied to the cam followers 608, 610, 612 and 702, which moves the driver plate 606 in a downward direction, which, in turn, loads the springs 810. There are three dog leg drivers, such as dog leg driver 808, illustrated in FIG. 8, that move in a downward (longitudinal) direction in response to the force created by springs 810. Dog leg driver 808, as shown in FIG. 8, has a slanted surface that engages a slanted surface of dog leg slide 812. As the dog leg driver 808 moves in a downward direction, the dog leg slide 812 moves in a lateral or horizontal direction to the right, as shown in FIG. 8. The finish curl roller 814 is mounted in an opening in the dog leg slide 812, so that the finish curl roller 814 moves in a lateral or a horizontal direction to the right, to engage the curl 1104, as illustrated in FIG. 11. The spindle is then rotated to rotate the finish curl rollers to progressively finish the curls to create a completed curl as the finish rollers are progressively moved inwardly, in a lateral direction, towards the neck.

Various curl profiles can be used to form either partially closed curls or fully closed curls. As shown in FIG. 11, the curl 1104 is a partially closed curl. A fully closed curl can be formed by increasing the curl profile 1106 or moving the finish curl roller 814 to a more closed position and allowing lip 1102 to engage the curl and to close the curl to the sidewall of the can 1108. Additionally, the profile of the lip 1102 can be changed to produce either a closed curl or a partially open curl.

The advantage of the three-step process of completing the curl, including the formation of a pre-curl, is that the amount of vertical force is limited to the amount required to create the intermediate curl, which is less than any force required to crush the neck of the can in the longitudinal (vertical) direction. The primary force in completing the finished curl is directed in a lateral (horizontal) direction. The internal support plug includes a support 1106 that supports the neck of the can in a lateral (horizontal) direction, so that there is no damage to the neck of the metal bottle 101 when the lateral force is applied. Further, there are three total steps in forming the curl. The pre-curl step, the intermediate curl step, and the final curl step, as illustrated in FIGS. 3, 9 and 11, respectively. Again, the three-step process of curling the neck to a completed curl configuration allows for greater tolerances and less spring-back than if the process were completed in only one or two steps. If the full curl were to be formed in one operation, the formation of the full curl would have to be over-curled, to ensure that the curl was properly formed, as a result of spring-back. The tolerances of the top surface of a curl that is formed in a single operation may be less than desirable, as a result of the curl being over-formed or over-curled and then sprung back to a proper position. By using this three-step process, there is clearly less spring-back that occurs in the initial pre-curl process, the intermediate curl process, and the final curl process, as disclosed in FIGS. 3, 9 and 11, respectively. This three-step process provides for greater design capability and produces tighter tolerances as to the shape and flatness of the curl, which helps in the sealing process of sealing a cap with coating or compound to the top surface of the curl. Each of the progressive steps allows for modification and correction of imperfections in the previous step, which allows for even closer tolerances in the final curl process. Further, incremental working of the metal, that is already overworked, leads to less cracks and tends to allow for a more malleable metal in the curl that is produced as a result of less stress.

Figure 10:
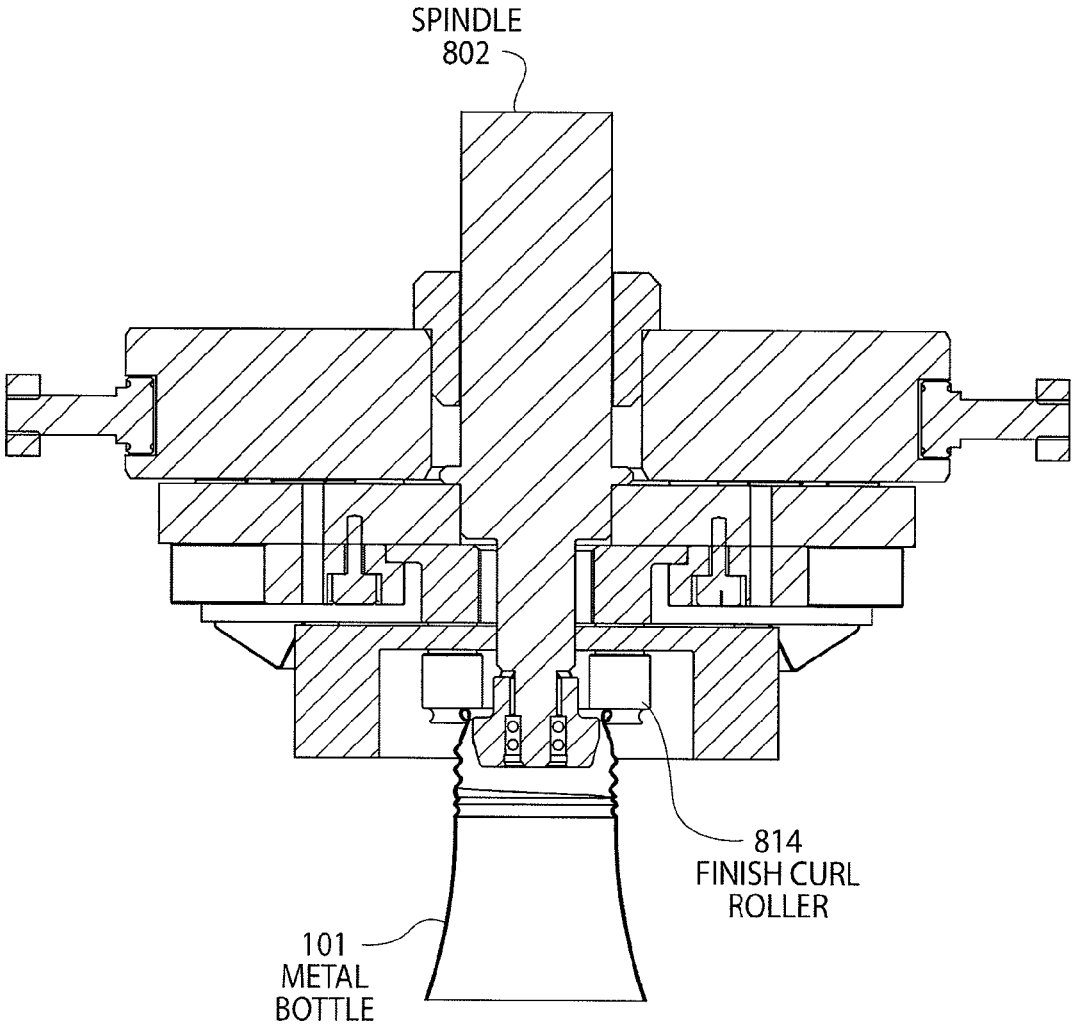
FIG. 10 is a cross-sectional view of FIG. 7.

FIG. 10 is a sectional view of FIG. 7. FIG. 10 illustrates the manner in which the finish curl roller 814 engages the intermediate curl 906 to form the final curl in the neck of the metal bottle 101. Finish curl rollers 814 progressively form the finish curl as a result of rotation of the spindle 802.

Figure 12:
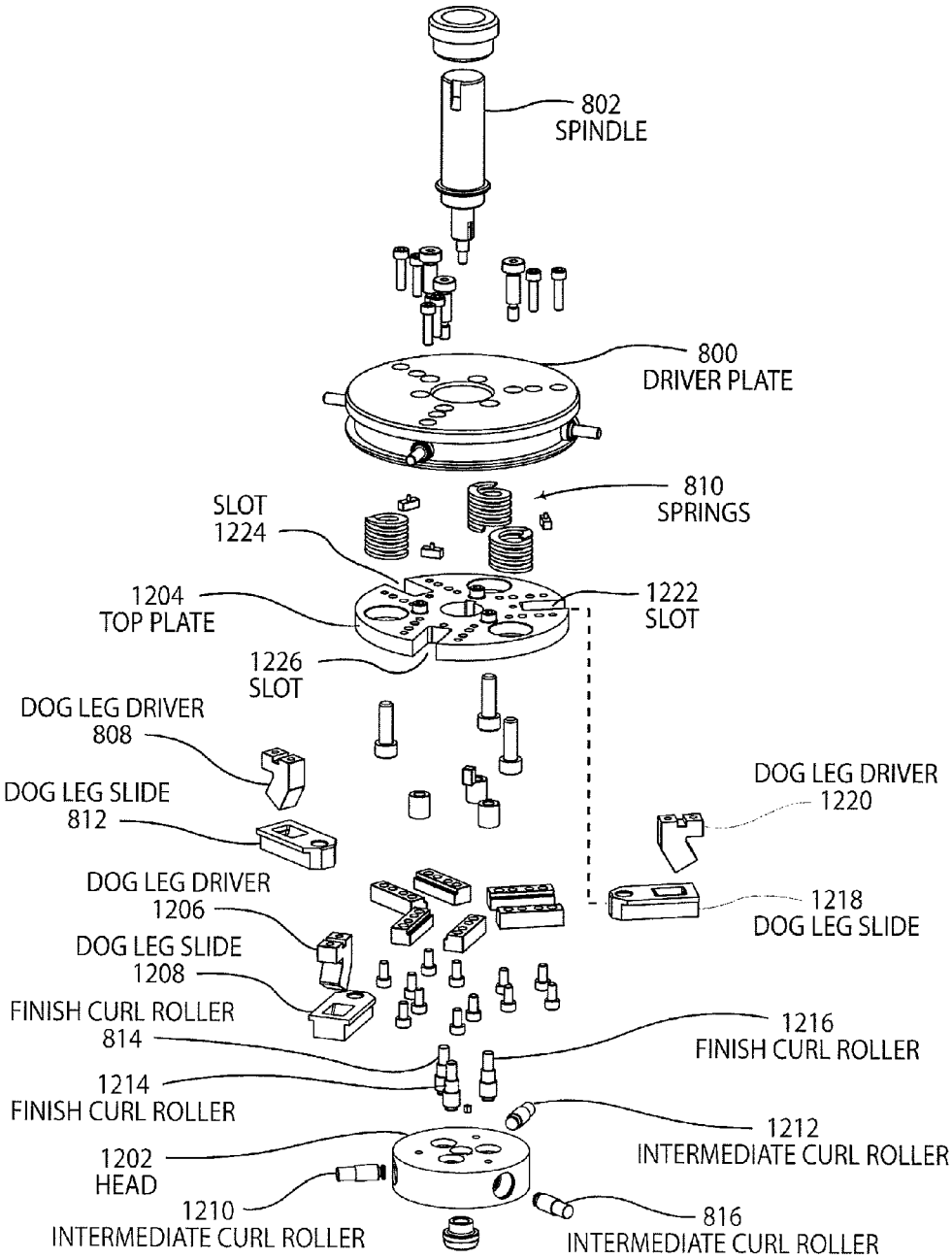
FIG. 12 is an assembly view of the top former illustrated in FIG. 6.

FIG. 12 is an exploded assembly drawing of the top former 600. As shown in FIG. 12, spindle 802 is inserted through the center opening in the drive plate 800. Springs 810 are mounted on the top plate 1204 to generate a force between the driver plate 800 and the top plate 1204. There are a series of three dog leg drivers 808, 1206 and 1220 that engage the dog leg slides 812, 1208 and 1218, respectively. As shown, the dog leg drivers and dog leg slides are mounted evenly around the top former 600 at 120°. The finish curl rollers 814, 1214 and 1216 are mounted in the cylindrical openings in dog leg slides 812, 1208 and 1218, respectively. The dog leg slides are mounted in the slots 1224, 1226 and 1222, respectively. The intermediate curl rollers 1210, 816 and 1212 are mounted evenly in openings in the head 1202 and interdisposed between the slots 1224, 1226 and 1222, so that there is a 60° difference between the intermediate curl rollers and the finish curl rollers. The geometry of the intermediate curl rollers and the finish curl rollers allows each of the intermediate curl rollers and each of the finish curl rollers to be evenly spaced and separated by equal distances between each other. This allows the top former 600 to be balanced and provide curl forming operations in an even and balanced manner, as the spindle 604 is rotated.

Figure 13:
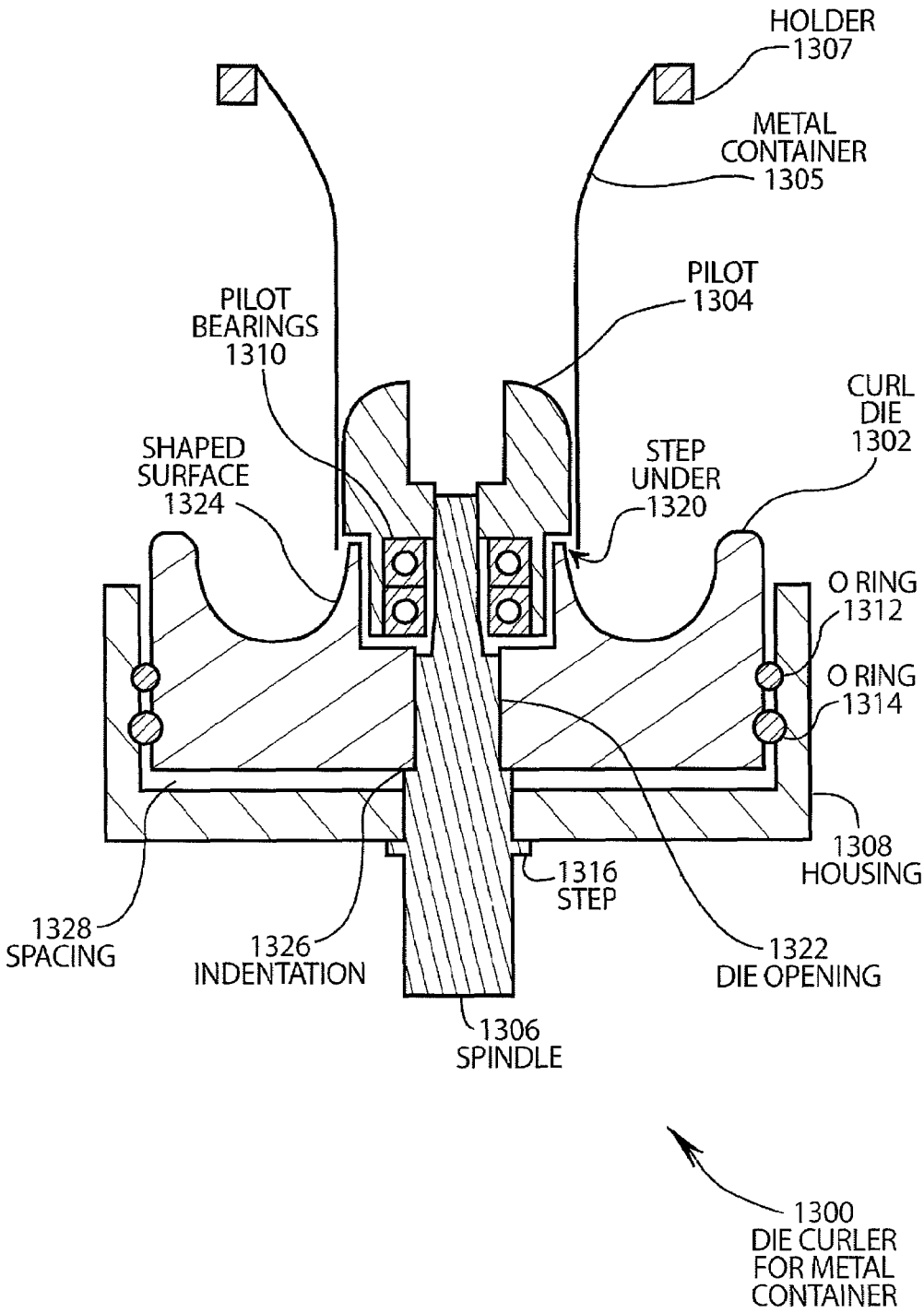
FIG. 13 is a cross-sectional view of an embodiment of a die curler.

FIG. 13 is a cutaway view of an embodiment of a die curler that utilizes a different principal of operation for forming a curl in a metal container 1305. The die curler 1300, illustrated in FIG. 13, can be used for metal bottles, aerosol bottles, or other types of bottles that use various types of closures. The die curler 1300, illustrated in FIG. 13, forms a curl in a single process, rather than in multiple steps.

As shown in FIG. 13, the die curler 1300 includes a curl die 1302, a pilot 1304, a spindle 1306, a housing 1308, and pilot bearings 1310. The curl die 1302 has a shaped surface 1324 for forming a curl in the metal container 1305. Various curl shapes 1324 can be used, depending upon the particular shape of the curl that is desired. Pilot 1304 functions to hold metal container 1305 in a centered position on the spindle 1306. Pilot 1304 is coupled to the spindle 1306 with pilot bearings 1310 that allow the pilot 1304 to spin freely on the spindle 1306. Pilot 1304 holds the metal container 1305 in a centered position on the spindle, as indicated above, and allows the metal container 1305 to spin on the pilot 1304 with respect to the curl die 1302. Housing 1308 is press fit onto the spindle 1306 until it abuts against step 1316. Similarly, the die opening 1322 of the curl die 1302 is press fit onto the spindle 1306 until the curl die 1302 abuts against indentation 1326, which provides a spacing 1328 between the curl die 1302 and the housing 1308. The die opening 1302 is placed off center from the centerline of the curl die 1302 by an amount of approximately 0.010 inches, but may vary between 0.005 inches to 0.015 inches. When the spindle 1306 is rotated, the curl die 1302 has an eccentric motion with respect to the centerline of spindle 1306 and pilot 1304.

As mentioned above, with respect to FIG. 13, pilot 1304 is placed on a centerline of the spindle 1306. Pilot 1304 can be held on the spindle 1306 by the pilot bearings 1310, or, alternatively, a screw or pin can be used to pin the pilot 1304 to the spindle 1306. Pilot 1304 holds the metal container 1305 on the centerline of the spindle 1306 so that the eccentric motion of the surface 1304 of the curl die 1302 causes a curl to be progressively formed at the end of metal container 1305, as metal container 1305 is moved progressively downwardly to engage the curl die 1302. A holder 1307, which is schematically shown in FIG. 13, may hold the bottle in a stationary position and force the bottle downwardly on the pilot 1304 until it engages the curl die 1302. The curl die 1302 rotates in response to rotation induced by the spindle 1306, which causes a curl to be progressively formed in the metal container 1305 as a result of the curl shape 1304 and the eccentric motion of the shaped surface 1324 of the curl die 1302. The step under 1320 is about 0.010 inches less than the diameter of pilot 1304. The step under 1320 ensures that there is a smooth transition from the pilot 1304 to the surface of the curl die 1302. Disposed on the lateral portions of the spacing 1328 are O-rings 1312, 1314. The purpose of the O-rings is to dampen vibration of the curl die 1302, as it spins on the spindle 1306. Since the curl die 1302 is eccentrically mounted on the spindle 1306, vibration is created when the spindle 1306 is rotated. Since housing 1308 also rotates with the curl die 1302, the O-rings 1312, 1314 are mounted between curl die 1302 and housing 1308 to absorb vibrational forces created as a result of the eccentricity of the curl die 1302.

During the curl forming process that is performed in accordance with the embodiment illustrated in FIG. 13, the spindle 1306 is rotated at approximately 200 RPM. This allows the curl die 1302 to engage the neck of the metal container 1305 and form a curl at the end of the neck of the metal container 1305. Of course, the spindle 1306 can be rotated at any desired speed and may be slowed toward the end of the die curling process, as the formation of the curl is completed. Alternatively, holder 1307 may progressively release pressure on the metal container 1305 to allow the metal container to rotate with the curl die 1302 toward the end of the forming process. Either of these processes can be used as desired. The metal container 1305, as disclosed above, is held in place by the pilot 1304 as it is being forced down onto the die 1302. The pilot 1304 has a diameter that is approximately 0.010 inches greater than the inner diameter of the metal container 1305 at the neck, to guarantee that the metal container 1305 is held in a central position on the pilot 1304, to guarantee concentric curling at the end of the neck of the metal container 1305.

Hence, the eccentric motion of the die curl shaped surface 1324 progressively forms the curl and works the metal in the neck of the metal container 1305 to progressively form a curl in accordance with the shaped surface 1324. In this manner, a curl can be formed in the neck of a metal container 1305 in a single process.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A process of forming a curl at the end of a neck of a metal container comprising:

providing a symmetrical curl die having a centerline and an opening in said curl die that is off-center from said centerline;

placing a spindle through said opening in said curl die so that said curl die is eccentrically mounted on said spindle;

rotatably mounting a pilot on said spindle in alignment with said centerline so that said pilot rotates concentrically around said spindle;

rotating said spindle so that said curl die rotates eccentrically around said centerline;

placing said neck of said container over said pilot so that said neck of said container is aligned with said centerline;

progressively engaging said neck of said container with said curl die as said curl die rotates eccentrically around said spindle to progressively form said curl in said neck.

2. The method of claim 1 wherein said process of rotatably mounting said pilot on said spindle comprises rotatably mounting said pilot to said spindle using a pilot bearing.

3. The method of claim 2 further comprising:

mounting a housing concentrically on said spindle around said curl die.

4. The method of claim 3 further comprising:

placing compressible material between said housing and said curl die to dampen vibration as said spindle is rotated.

5. A device for forming a curl at the end of a neck of a metal container comprising:

a pilot that is inserted in an opening of said neck of said metal container that holds said metal container in a substantially stationary position;

a spindle that is concentrically rotatably attached to said pilot so that said spindle rotates concentrically with respect to said container;

a curl die that is eccentrically mounted to said spindle that progressively engages said neck as said curl die is rotated by said spindle.

6. The device of claim 5 further comprising:

a holder that holds said metal container on said pilot and moves said container so that said neck of said container engages said curl die.

* * * * *